US007157652B2

(12) United States Patent
Fabian et al.

(10) Patent No.: US 7,157,652 B2
(45) Date of Patent: Jan. 2, 2007

(54) IN-LINE SLIDE SWITCH ASSEMBLY FOR HOT PLUGGING

(75) Inventors: David James Fabian, Mount Joy, PA (US); John Michael Landis, Camp Hill, PA (US)

(73) Assignee: Tyco Electronics Corporation, Middletown, PA (US)

( * ) Notice: Subject to any disclaimer, the term of this patent is extended or adjusted under 35 U.S.C. 154(b) by 52 days.

(21) Appl. No.: 11/122,487

(22) Filed: May 4, 2005

(65) Prior Publication Data

US 2006/0249360 A1 Nov. 9, 2006

(51) Int. Cl.
*H01H 15/00* (2006.01)

(52) U.S. Cl. ..... 200/16 B; 200/51 R

(58) Field of Classification Search ..... 200/51 R, 200/531, 541, 550, 547, 549, 563, 571, 57
See application file for complete search history.

(56) References Cited

U.S. PATENT DOCUMENTS 512,774 A * 1/1894 Warner ..... 200/550
717,724 A * 1/1903 Thompson ..... 200/550
2,914,639 A * 11/1959 Freeland ..... 200/504
3,174,002 A * 3/1965 Golbeck ..... 200/16 D
3,374,449 A * 3/1968 Moore et al. ..... 333/262
4,166,934 A 9/1979 Marrero
4,822,961 A * 4/1989 Hugin et al. ..... 200/16 R
6,355,991 B1 3/2002 Goff et al.
6,434,652 B1 8/2002 Bailis et al.
6,564,279 B1 5/2003 Neil et al.
6,587,909 B1 7/2003 Olarig et al.
6,704,825 B1 3/2004 Lascu et al.

* cited by examiner

*Primary Examiner*—Michael Friedhofer
*Assistant Examiner*—Lisa Klaus

(57) ABSTRACT

The present disclosure relates to switches and assemblies configured and adapted to enable "hot plugging" of electrical components and/or elements. According to an embodiment, slide switch assembly includes a body portion configured and adapted to support a first and a second spaced apart contact pin therein; and a plunger slidably supported within the body portion. Each contact pin is electrically connectable to an electrical conduit. The plunger has a first position in electrical contact with one of the first and second contact pins, and a second position in electrical contact with both the first and second contact pins. In use, when the plunger is in the second condition electrical current is transmitted between the first and the second contact pins.

18 Claims, 6 Drawing Sheets

IN-LINE SLIDE SWITCH ASSEMBLY FOR HOT PLUGGING

BACKGROUND

1. Technical Field

The present disclosure relates to electrical connectors and, more particularly, to in-line slide switches and assemblies for hot plugging and the like.

2. Background of Related Art

Industry data has shown that a leading cause of fatalities for electricians is electrocution while working on 277V lighting systems. Electricians are often pressured to change out ballasts while the circuits are energized to avoid removing illumination from the area. When the electrician gets to the wire nut, with three white wires (neutral), the thought is that these wires are grounded conductors and therefore are not a hazard. Typically, the electrician unscrews or otherwise opens the nut and gets between two of the white wires, resulting in shock or electrocution. These white wires carry the unbalanced load current from all phases of the white wires.

Accordingly, the need exists for systems and devices which allow electricians to de-energize a ballasted illuminaire without removing illumination to an entire area.

The need exists for systems and devices which enable the safe changing of ballasts, by an electrician or the like, without being exposed to a shock hazard.

The need exists for systems and devices capable of effectuating "hot plugging" of electrical components and/or elements as needed and/or desired.

SUMMARY

The present disclosure relates to switches and assemblies configured and adapted to enable "hot plugging" of electrical components and/or elements.

According to an aspect of the present disclosure, a slide switch assembly is provided. Slide switch assembly includes a body portion configured and adapted to support a first and a second spaced apart contact pin therein; and a plunger slidably supported within the body portion. Each contact pin is electrically connectable to an electrical conduit. The plunger has a first position in electrical contact with one of the first and second contact pins, and a second position in electrical contact with both the first and second contact pins. In use, when the plunger is in the second condition electrical current is transmitted between the first and the second contact pins.

The plunger includes a first end and a second end each defining a recess therein for slidably engaging a respective contact pin. The plunger may include an electrical sleeve operatively disposed within each end thereof. Each electrical sleeve defines at least one contact point with a respective contact pin.

The slide switch assembly may further include an actuation slide slidably supported on the body portion and in operative engagement with the plunger. Accordingly, in use, axial slidable movement of the actuation slide along the body portion results in movement of the plunger. The plunger may include a tab, extending therefrom and through a slot formed in the body portion, for operatively engagement with the actuation slide.

The plunger is fabricated from an electrically conductive material. It is envisioned that the body portion and the actuation slide are electrically insulative.

The slide switch assembly may further include indicia indicating to the user when the plunger is in the first or second condition. The slide switch assembly may further include tactile feedback elements between the body portion and the actuation slide for providing the user with tactile indications regarding the condition of the plunger. The tactile feedback elements may include at least one detent formed on an outer surface of the body portion and at least one annular groove formed in an inner surface of the annular slide.

According to another aspect of the present disclosure, a slide switch assembly, for performing hot plugging, is provided. The slide switch assembly includes a body portion; a first and a second contact pin operatively supported in the body portion, the first and the second contact pin being spaced from one another, wherein each contact pin is electrically connectable to an electrical conduit; a plunger slidably supported within the body portion, the plunger having a first position in electrical contact with one of the first and second contact pins, and a second position in electrical contact with both the first and second contact pins; wherein when the plunger is in the second condition electrical current is transmitted between the first and the second contact pins; and an actuation slide slidably supported on the body portion, the actuation slide being in operative engagement with the plunger, wherein axial movement of the actuation slide results in axial movement of the plunger.

The plunger may include a first end and a second end each defining a recess therein for slidably engaging a respective contact pin. The plunger may include an electrical sleeve operatively disposed within each end thereof. Each electrical sleeve may define at least one contact point with a respective contact pin. The plunger may include a tab extending therefrom and through a slot formed in the body portion, wherein the tab operatively engages the actuation slide.

The plunger is fabricated from an electrically conductive material. The body portion and the actuation slide are electrically insulative.

The slide switch assembly further includes indicia indicating to the user when the plunger is in the first or second condition. The slide switch assembly further includes tactile feedback elements between the body portion and the actuation slide for providing the user with tactile indications regarding the condition of the plunger. The tactile feedback elements include at least one detent formed on an outer surface of the body portion and at least one annular groove formed in an inner surface of the annular slide.

The slide switch assembly may further include crimping elements supported in the body portion for electrically connecting each contact pin to a respective electrical conductor.

For a better understanding of the present invention and to show how it may be carried into effect, reference will be made by way of example to the accompanying drawings.

DETAILED DESCRIPTION OF EMBODIMENTS

Figure 1:
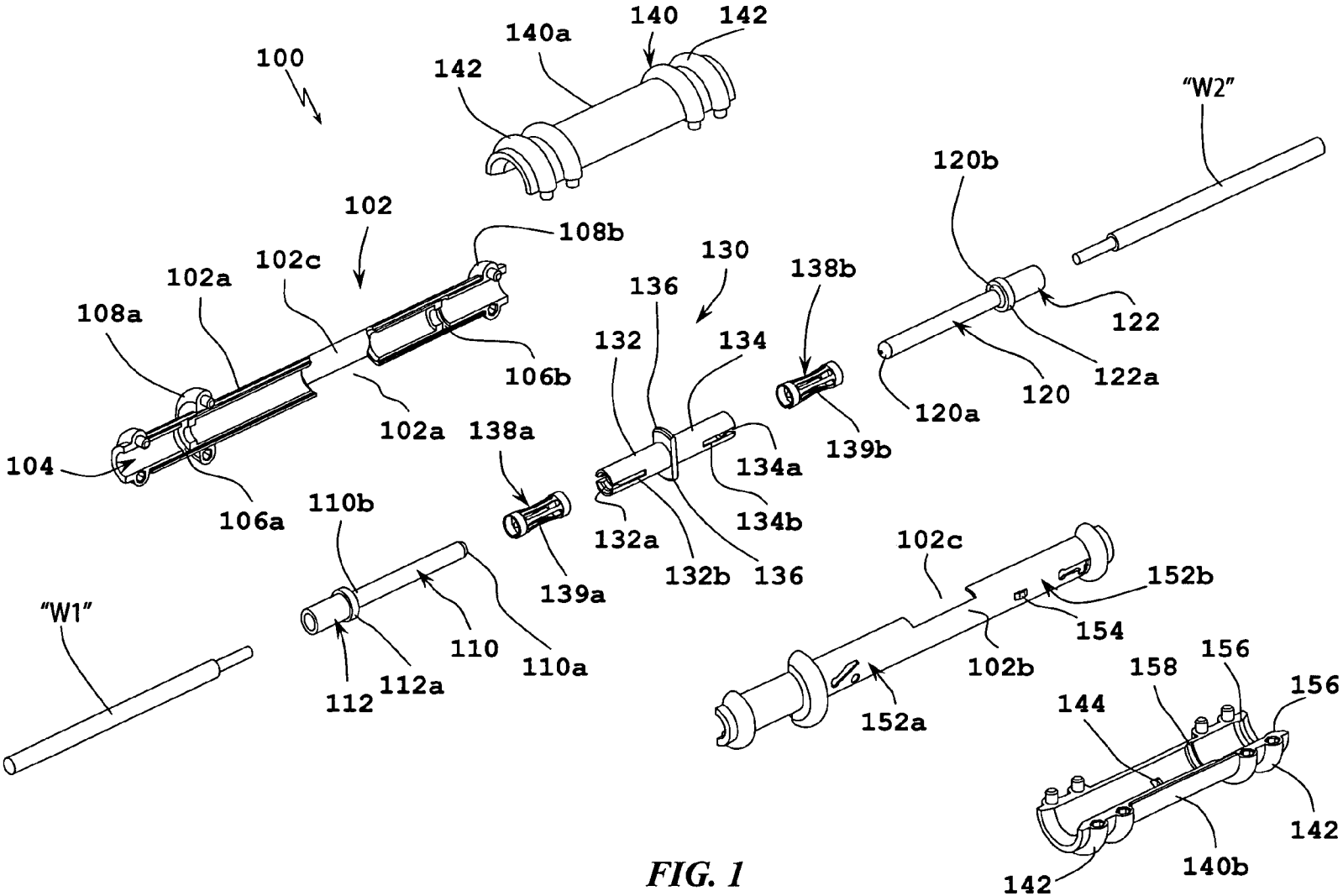
FIG. 1 is a perspective view, with parts separated, of a slide switch assembly according to an embodiment of the present disclosure.

Embodiments of the presently disclosed slide switch assembly for "hot plugging" will now be described in detail with reference to the drawing figures wherein like reference numerals identify similar or identical elements. As used herein and as is traditional, the term "distal" refers to that portion which is furthest from the user while the term "proximal" refers to that portion which is closest to the user. In addition, terms such as "above", "below", "forward", "rearward", etc. refer to the orientation of the figures or the direction of components and are simply used for convenience of description.

Referring to FIGS. 1–6, a switch assembly in accordance with an embodiment of the present disclosure is generally designated as 100. Switch assembly 100 includes an elongate body portion 102 defining a lumen 104 extending therethrough. As seen in FIG. 1, body portion 102 may include a top-half shell section 102*a* and a bottom-half shell section 102*b*. Top-half shell section 102*a* and a bottom-half shell section 102*b* may be secured and/or bonded together using methods known by those skilled in the art.

Body portion 102 includes at least one elongate, longitudinally oriented slot 102*c* formed therein and extending into lumen 104 thereof. Body portion 102 of switch assembly 100 is fabricated from an electrically non-conductive or insulative material. In this manner, no current is transmitted through body portion 102 of switch assembly 100.

Figure 3:
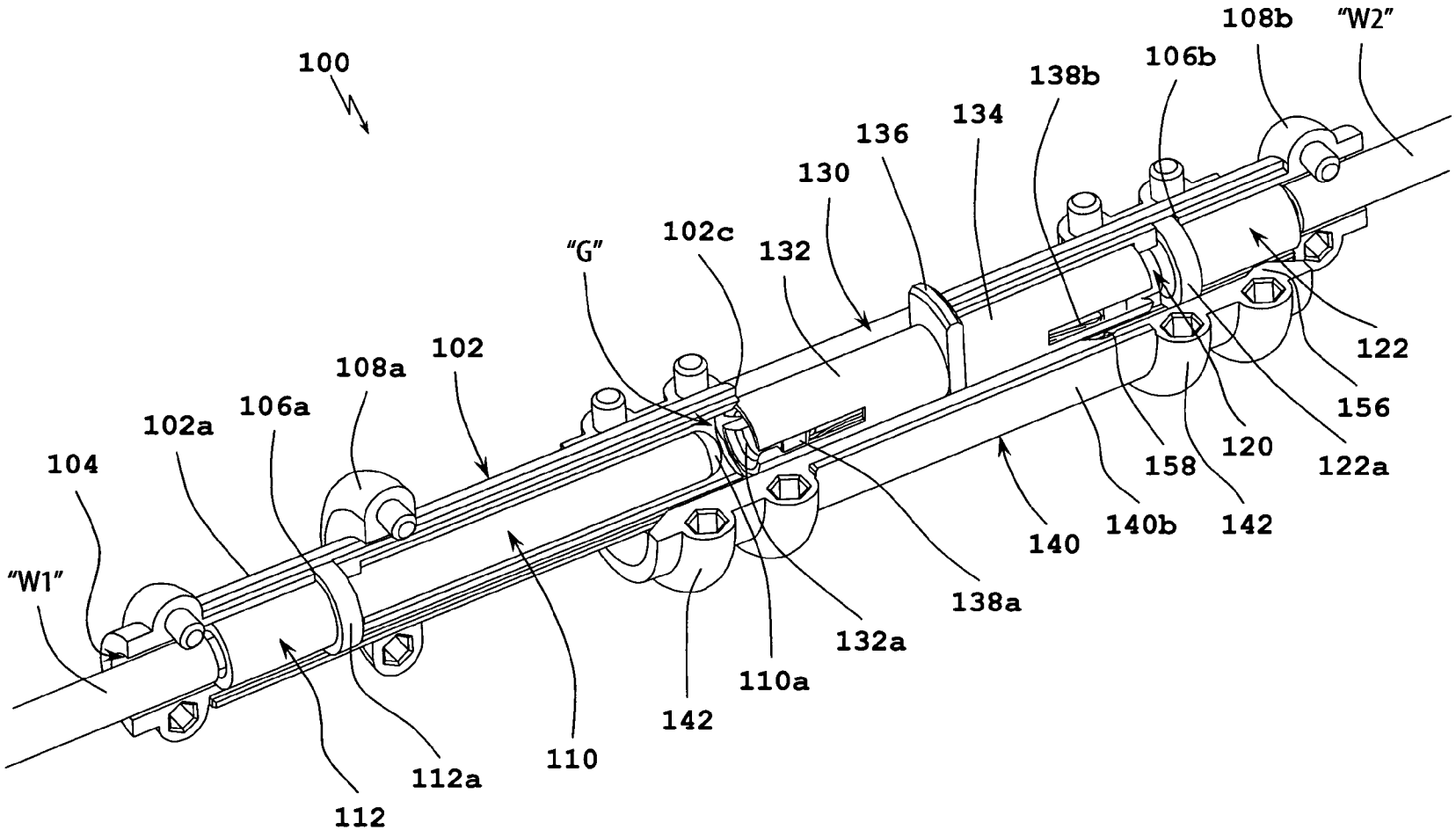
FIG. 3 is a partial cross-sectional, perspective view of the slide switch assembly of FIG. 2, shown in the first or open condition.

Switch assembly 100 includes a first or distal contact pin 110 operatively supported within lumen 104 of body portion 102, and a second or proximal contact pin 120 operatively supported within lumen 104 of body portion 102. First and second contact pins 110, 120 are spaced from one another and define a gap or space "G" therebetween, as shown in FIG. 3. Each contact pin 110, 120 includes a contoured or rounded free end 110*a*, 120*a*, respectively.

Switch assembly 100 includes crimping or clamping elements 112, 122 for electrically connecting electrical wires "W1, W2" to second ends 110*b*, 120*b* of respective contact pins 110, 120. Each crimping element 112, 122 may include an annular flange 112*a*, 122*a*, respectively, which is received in respective annular grooves 106*a*, 106*b* formed in lumen 104 of body portion 102. In this manner, the position of contact pins 110, 120 within lumen 104 of body portion 102 is fixed.

Switch assembly 100 includes a plunger 130 slidably disposed within lumen 104 of body portion 102. Plunger 130 includes a first end 132 defining a recess 132*a* formed therein for selectively, slidably receiving free end 110*a* of first contact pin 110, and a second end 134 defining a recess 134*a* therein for selectively, slidably receiving the free end 120*a* of the second contact pin 120. Each end 132, 134 includes a respective transverse slot 132*b*, 134*b* formed therein which permits ends 132, 134 of plunger 130 to expand radially outward upon insertion of a respective contact pin 110, 120 therein.

Figure 5:
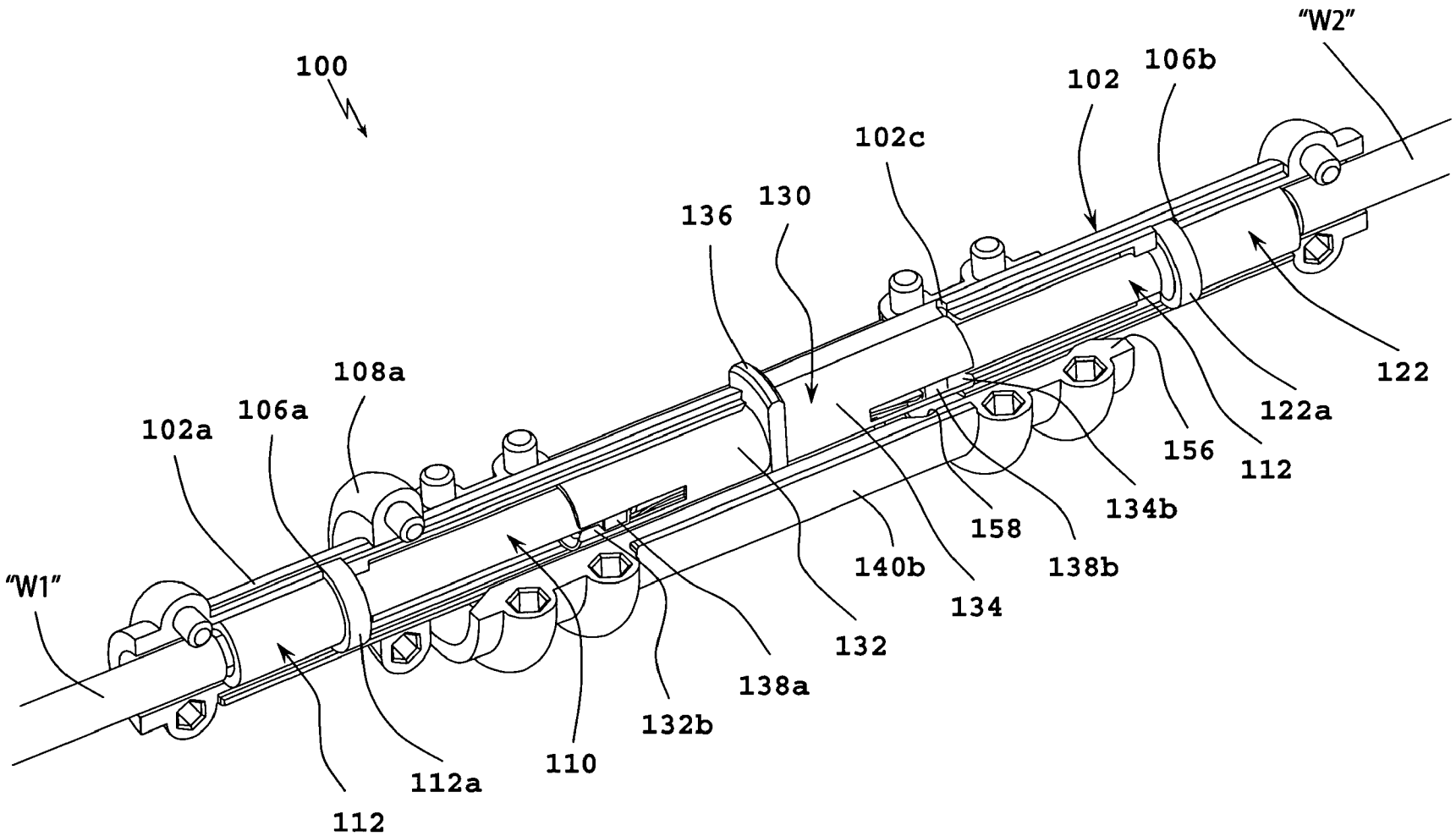
FIG. 5 is a partial cross-sectional, perspective view of the slide switch assembly of FIGS. 1–4, shown in the second or closed condition.
Figure 6:
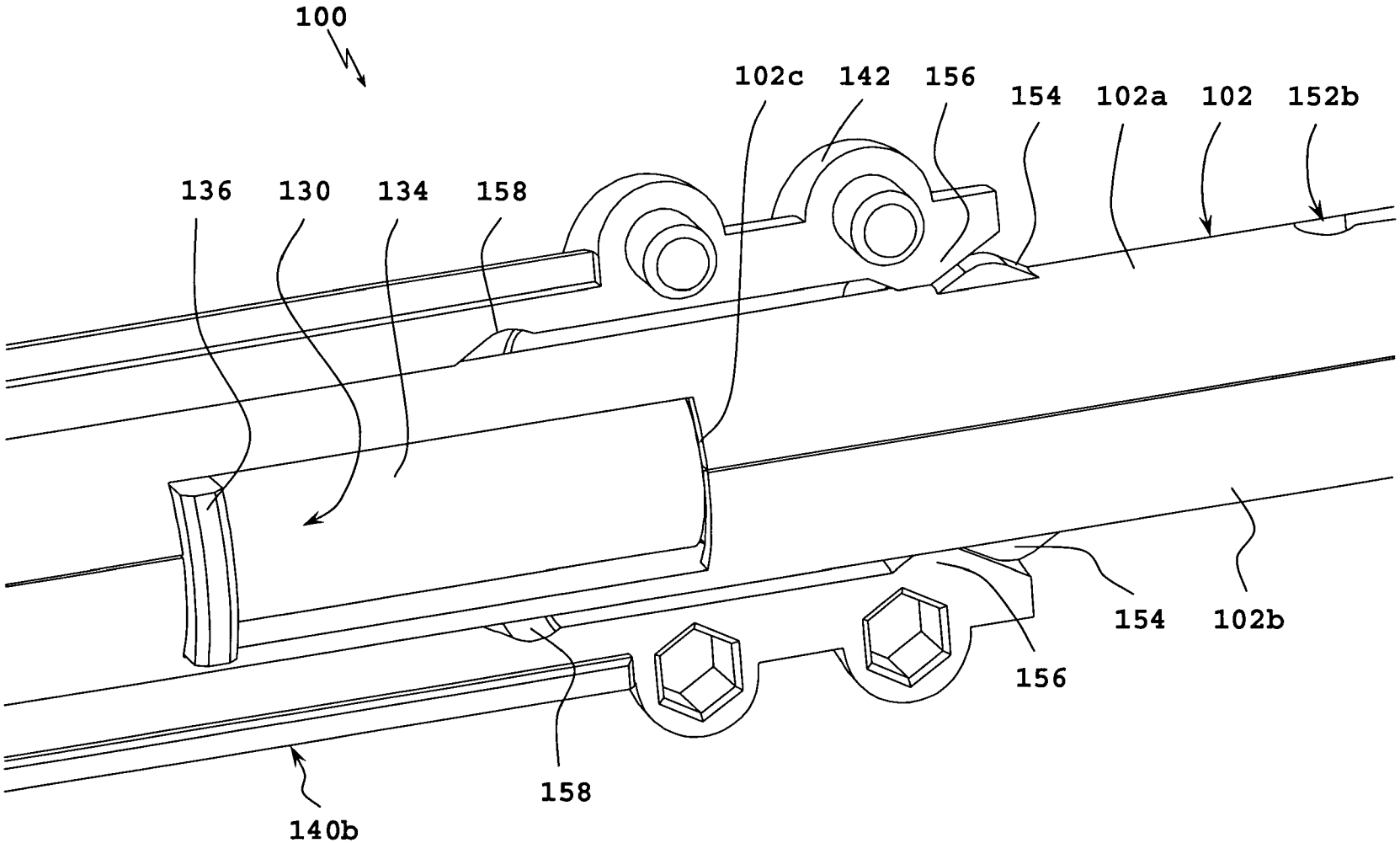
FIG. 6 is an enlarged view of the indicated area of detail of FIG. 5, illustrating the tactile feedback elements.

As seen in FIGS. 3, 5 and 6, plunger 130 includes at least one tab 136 extending substantially radially from an outer surface thereof and slidably through an elongate slot 102*c* formed in body portion 102.

Switch assembly 100 includes sleeve-like electrical contacts or louvertacs 138*a*, 138*b* disposed within respective ends 132, 134 of plunger 130. Plunger 130 is fabricated from an electrically conductive material capable of transmitting electrical current between electrical sleeves 138*a*, 138*b*. Accordingly, in use, plunger 130 takes the initial spark and dissipates heat when first and second contact pins 110, 120 are electrically connected to one another. Each electrical sleeve 138*a*, 138*b* is configured and dimensioned to slidably receive and engage a respective contact pin 110, 120 therein. Accordingly, in use, plunger 130 and electrical sleeves 138*a*, 138*b* electrically interconnect first contact pin 110 to second contact pin 120 when plunger 130 is in the second or closed condition.

In an alternative embodiment, plunger 130 may be fabricated from electrically insulative materials, such that, in use, plunger 130 does not itself transmit electrical current between first and second contact pins 110, 120. Additionally, an electrical conduit may be provided between each electrical sleeve 138*a*, 138*b*. Alternatively, electrical sleeves 138*a*, 138*b* may be in direct electrical contact with one another.

Each electrical sleeve 138*a*, 138*b* includes a plurality of radially inward projecting ribs 139*a*, 139*b*, respectively, which provide a multiplicity of points or contact with contact pins 110, 120.

Figure 2:
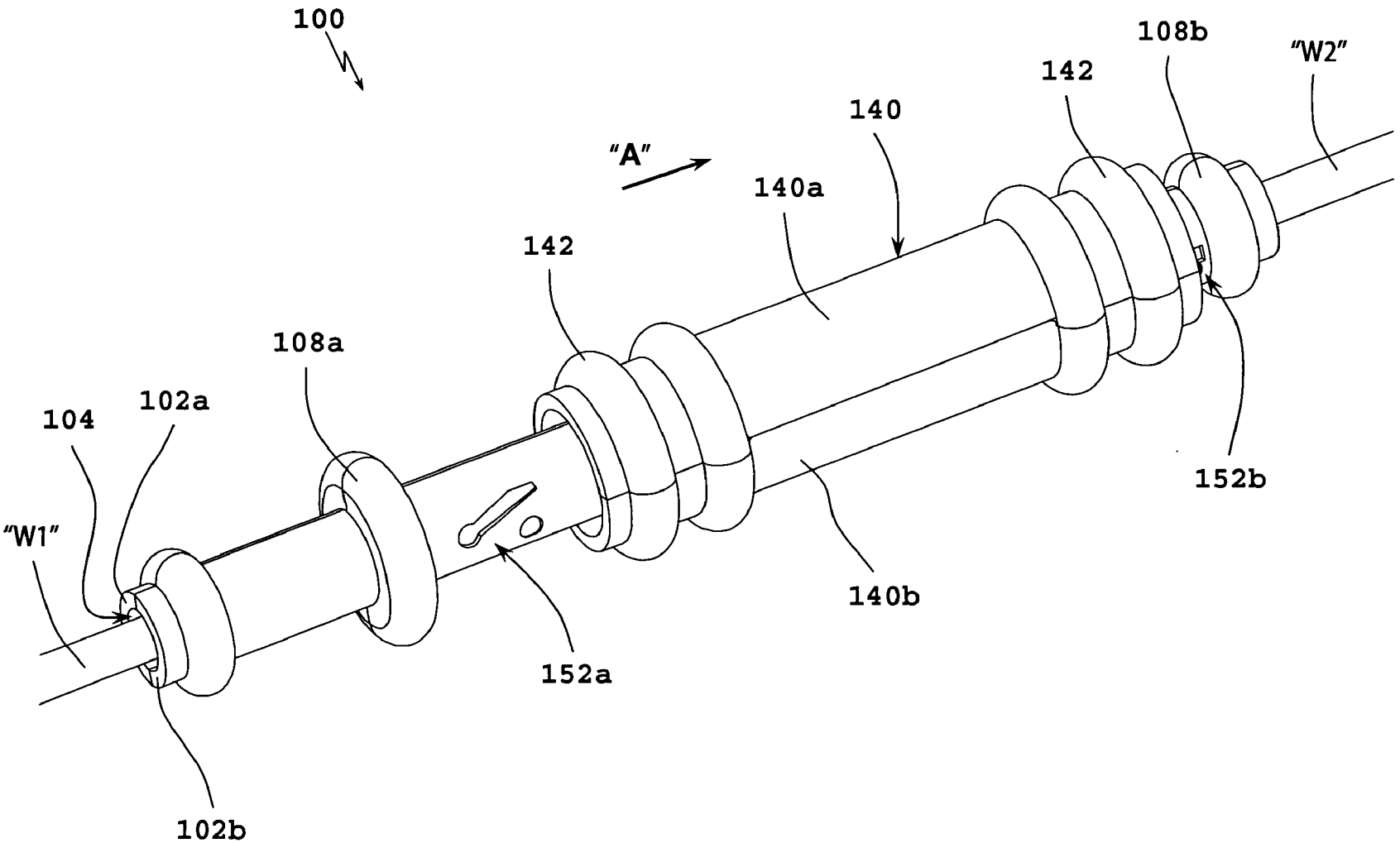
FIG. 2 is a perspective view of the slide switch assembly of FIG. 1, shown in a first or open condition.
Figure 4:
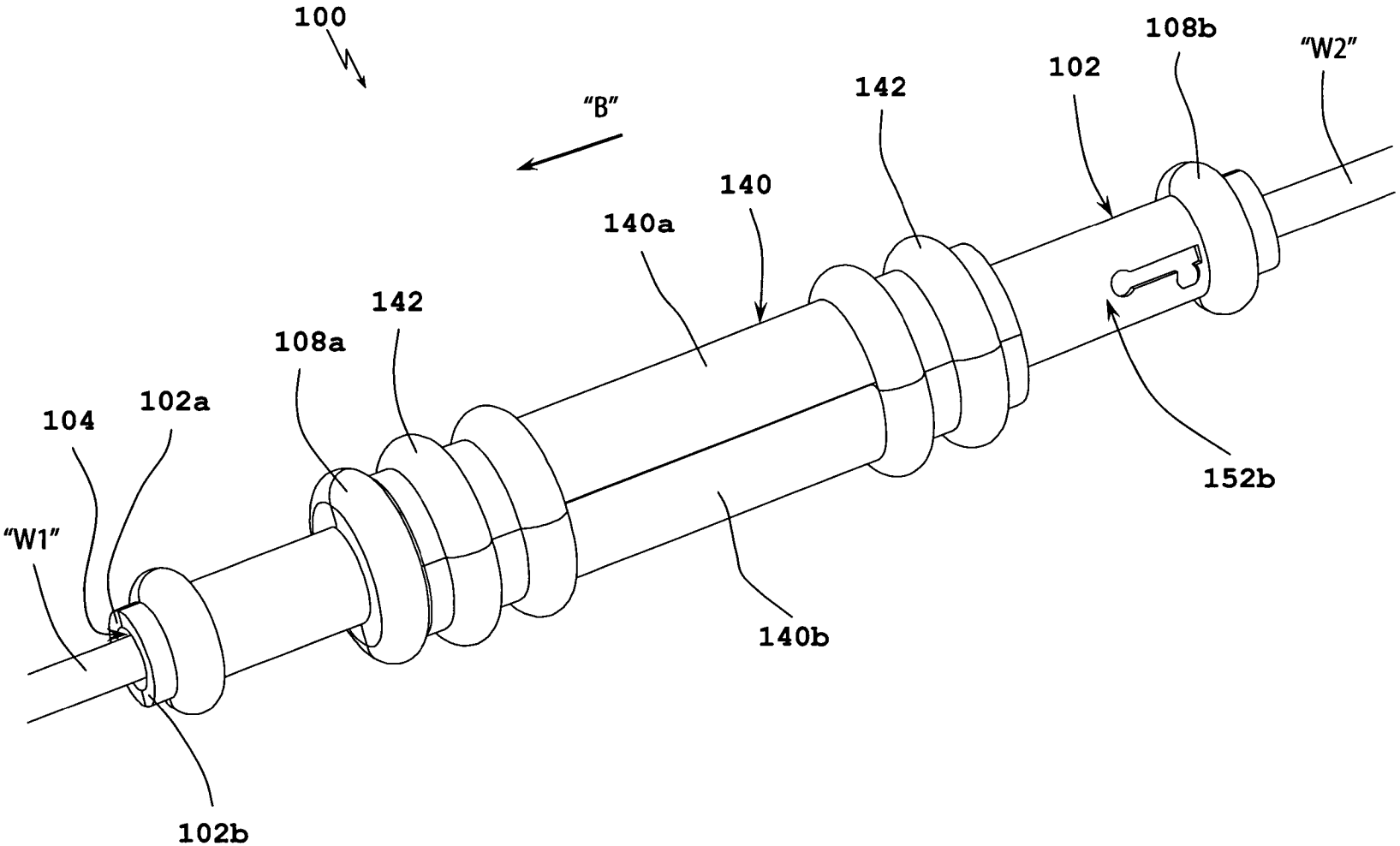
FIG. 4 is a perspective view of the slide switch assembly of FIGS. 1–3, shown in a second or closed condition.

As seen in FIGS. 2 and 3, plunger 130 includes a first or opened condition wherein plunger 130 is located at a right-most position (as indicated by arrow "A") such that first end 132 of plunger 130 is not in electrical contact with first contact pin 110. In the first or open condition no electrical current is transmitted between first contact pin 110 and second contact pin 120. As seen in FIGS. 4 and 5, plunger 130 includes a second or closed condition wherein plunger 130 is located at a left-most position (as indicated by arrow "B") such that first end 132 of plunger 130 is in electrical contact about first contact pin 110. In the second or closed condition electrical current may be transmitted between first contact pin 110 and second contact pin 120.

Switch assembly 100 further includes an actuation slide 140 slidably supported about body portion 102. Actuation slide 140 includes an internal recess 144 (shown in FIG. 1) configured and dimensioned to receive tab 136 of plunger 130. In this manner, as actuation slide 140 is slidably moved along body portion 102, plunger 130 is slidably displaced within lumen 104 of body portion 102.

Actuation slide 140 is made from a non-conductive or electrically insulative material such that electrical current does not escape through tab 136 of plunger 130. Actuation slide 140 may include a top-half shell section 140*a* and a bottom-half shell section 140*b*. Top-half shell section 140*a* and a bottom-half shell section 140*b* may be secured and/or bonded together using methods known by those skilled in the art.

As seen in FIGS. 1–3, actuation slide 140 includes a first or opened condition wherein actuation slide 140 is located at a right-most position (as indicated by arrow "A") so that first end 132 of plunger 130 is not in electrical contact with first contact pin 110. As mentioned above, in the first or open condition no electrical current is transmitted between first contact pin 110 and second contact pin 120. As seen in FIGS. 4 and 5, actuation slide 140 includes a second or closed condition wherein actuation slide 140 is located at a left-most position (as indicated by arrow "B") so that first end 132 of plunger 130 is in electrical contact about first contact pin 110. As mentioned above, in the second or closed condition electrical current may be transmitted between first contact pin 110 and second contact pin 120.

Switch assembly 100 may include a pair of spaced apart annular flanges 108*a*, 108*b* provided on an outer surface of body portion 102. Annular flanges 108*a*, 108*b* define proximal and distal stops for actuation slide 140.

Switch assembly 100 may include first indicia 152*a* which indicates when switch assembly 100 is in the first or open condition. Switch assembly 100 may further include second indicia 152*b* which indicates when switch assembly 100 is in the second or closed condition. In an embodiment, indicia 152*a*, 152*b* may be in the form of recesses or ink stamped formed in body portion 102. Accordingly, in use, as actuation slide 140 and plunger 130 are moved between the first and second conditions, actuator slide 140 is positioned over indicia 152*a*, 152*b* and thus is a visible indicator of its electrical condition. In this manner, the recess or colored ink of indicia 152*a*, 152*b* will be discernable and visible to the user.

As seen in FIGS. 1, 3, 5 and 6, switch assembly 100 includes tactile feedback elements provided on the outer surface of body portion 102 and the inner surface of actuation slide 140. In particular, the tactile feedback elements include at least one detent 154 formed and projecting from an outer surface of body portion 102, and an annular rib 156 formed and projecting from an inner surface of actuation slide 140. The tactile feedback elements further includes an annular groove 158 formed in the inner surface of body portion 140. Annular groove 158 functions as a stop and is configured and dimensioned to selectively receive detent 154 therein.

Switch assembly 100 further includes finger grips 142 provided on actuation slide 140 for facilitating the movement (i.e., sliding movement) of actuation slide 140 and plunger 130 relative to body portion 102.

In use, switch assembly 100 is typically maintained in the closed condition, as seen in FIGS. 4–5, wherein electrical current is flowing between first and second contact pins 110, 120 and first and second wires "W1, W2". As described above, when switch assembly 100 is in the closed condition, first contact pin 110 is in electrical contact with second contact pin 120 through electrical sleeves 138*a*, 138*b* and plunger 130. In order to perform a "hot swapping" or a "hot plugging" procedure, switch assembly 100 is placed in an open condition by moving actuation slide 140 along body portion 102, in the direction of arrow "A", as seen in FIG. 2. As described above, when switch assembly 100 is in the open condition, first contact pin 110 is electrically disconnected from second contact pin 120. In particular, actuation slide 140 and plunger 130 are positioned such that first end 132 is spaced from and/or disconnected from first contact pin 110.

It is to be understood that the foregoing description is merely a disclosure of particular embodiments and is no way intended to limit the scope of the invention. Other possible modifications will be apparent to those skilled in the art and all modifications will be apparent to those in the art and all modifications are to be defined by the following claims.

What is claimed is:

1. A slide switch assembly, comprising:

a body portion configured and adapted to support a first and a second spaced apart contact pin therein, wherein each contact pin is electrically connectable to an electrical conduit;

a plunger slidably supported within the body portion, the plunger having a first position in electrical contact with one of the first and second contact pins, and a second position in electrical contact with both the first and second contact pins; and an actuation slide slidably supported on the body portion and in operative engagement with the plunger;

wherein when the plunger is in the second condition electrical current is transmitted between the first and the second contact pins, wherein the body portion and the actuation slide are electrically insulative.

2. The slide switch assembly according to claim 1, wherein the plunger is fabricated from an electrically conductive material.

3. The slide switch assembly according to claim 2, wherein the plunger includes a first end and a second end each defining a recess therein for slidably engaging a respective contact pin.

4. The slide switch assembly according to claim 3, wherein the plunger includes an electrical sleeve operatively disposed within each end thereof, each electrical sleeve defines at least one contact point with a respective contact pin.

5. The slide switch assembly according to claim 4, wherein axial slidable movement of the actuation slide along the body portion results in movement of the plunger.

6. The slide switch assembly according to claim 5, wherein the plunger includes a tab extending therefrom and through a slot formed in the body portion, wherein the tab operatively engages the actuation slide.

7. The slide switch assembly according to claim 1, further comprising indicia indicating to the user when the plunger is in the first or second condition.

8. The slide switch assembly according to claim 7, further comprising tactile feedback elements between the body portion and the actuation slide for providing the user with tactile indications regarding the condition of the plunger.

9. The slide switch assembly according to claim 8, wherein the tactile feedback elements include at least one detent formed on an outer surface of the body portion and at least one annular groove formed in an inner surface of the annular slide.

10. A slide switch assembly for performing hot plugging, the slide switch comprising:

a body portion;

a first and a second contact pin operatively supported in the body portion, the first and the second contact pin being spaced from one another, wherein each contact pin is electrically connectable to an electrical conduit;

a plunger slidably supported within the body portion, the plunger having a first position in electrical contact with one of the first and second contact pins, and a second position in electrical contact with both the first and second contact pins; wherein when the plunger is in the second condition electrical current is transmitted between the first and the second contact pins; and an actuation slide slidably supported on the body portion, the actuation slide being in operative engagement with the plunger, wherein axial movement of the actuation slide results in axial movement of the plunger, wherein the body portion and the actuation slide are electrically insulative.

11. The slide switch assembly according to claim 10, wherein the plunger is fabricated from an electrically conductive material.

12. The slide switch assembly according to claim 11, wherein the plunger includes a first end and a second end each defining a recess therein for slidably engaging a respective contact pin.

13. The slide switch assembly according to claim 12, wherein the plunger includes an electrical sleeve operatively disposed within each end thereof, each electrical sleeve defines at least one contact point with a respective contact pin.

14. The slide switch assembly according to claim 13, wherein the plunger includes a tab extending therefrom and through a slot formed in the body portion, wherein the tab operatively engages the actuation slide.

15. The slide switch assembly according to claim 10, further comprising indicia indicating to the user when the plunger is in the first or second condition.

16. The slide switch assembly according to claim 15, further comprising tactile feedback elements between the body portion and the actuation slide for providing the user with tactile indications regarding the condition of the plunger.

17. The slide switch assembly according to claim 16, wherein the tactile feedback elements include at least one detent formed on an outer surface of the body portion and at least one annular groove formed in an inner surface of the annular slide.

18. The slide switch assembly according to claim 17, further comprising crimping elements supported in the body portion for electrically connecting each contact pin to a respective electrical conductor.

* * * * *